US007322270B2

(12) United States Patent
Schmieding

(10) Patent No.: US 7,322,270 B2
(45) Date of Patent: Jan. 29, 2008

(54) SAFETY CIRCUIT FOR MEDIA-OPERATED CONSUMERS AND PROCESS FOR ITS OPERATION

(75) Inventor: Martin Schmieding, Bochum (DE)

(73) Assignee: Hydac System GmbH, Sulzbach/Saar (DE)

( * ) Notice: Subject to any disclaimer, the term of this patent is extended or adjusted under 35 U.S.C. 154(b) by 254 days.

(21) Appl. No.: 11/214,037

(22) Filed: Aug. 30, 2005

(65) Prior Publication Data

US 2006/0042250 A1 Mar. 2, 2006

(30) Foreign Application Priority Data

Aug. 31, 2004 (DE) ..... 10 2004 042 891

(51) Int. Cl.
*F15B 20/00* (2006.01)
*F01D 21/18* (2006.01)

(52) U.S. Cl. ..... 91/424; 60/657

(58) Field of Classification Search ..... 60/646, 60/657; 91/424
See application file for complete search history.

(56) References Cited

U.S. PATENT DOCUMENTS 2,866,470 A * 12/1958 Oberle et al. ..... 415/16
4,217,810 A * 8/1980 Vaudrey ..... 91/459
4,225,284 A * 9/1980 Masek et al. ..... 415/16
4,589,444 A * 5/1986 Masek et al. ..... 91/437
4,706,548 A * 11/1987 Baldauf et al. ..... 91/424
5,133,189 A * 7/1992 Hurley ..... 60/646
5,269,141 A * 12/1993 Burch et al. ..... 60/406

FOREIGN PATENT DOCUMENTS

EP 641919 A1 * 3/1995

* cited by examiner

*Primary Examiner*—Thomas E. Lazo
(74) *Attorney, Agent, or Firm*—Roylance, Abrams, Berdo & Goodman, L.L.P.

(57) ABSTRACT

A safety circuit for media-operated consumers, such as steam turbines or gas turbines, includes at least one first solenoid valve (1.1) which acts on a fluid circuit. An actuating device (9) can be connected to the fluid circuit, and acts at the same time on the operating behavior of the consumer. At least one other solenoid valve (1.2, 1.3) is connected at least to one of the other solenoid valves (1.1) such that only with simultaneous triggering of at least two solenoid valves (1.1, 1.2, 1.3) does at least one control valve (2.1), connected to the fluid circuit (10) act on the actuating device (9). Permanent verifiability can occur with simultaneous implementation of the safety function. A process for operating the safety circuit is also involved.

39 Claims, 8 Drawing Sheets

SAFETY CIRCUIT FOR MEDIA-OPERATED CONSUMERS AND PROCESS FOR ITS OPERATION

FIELD OF THE INVENTION

The present invention relates to a safety circuit for media-operted consumers, such as steam turbines or gas turbines. At least one solenoid valve acts on a fluid circuit, especially a hydraulic circuit, to which an actuating device is connected. The actuating device acts as the same time on operating behavior of the consumer, The present invention also relates to a processes for operation of the safety circuit.

BACKGROUND OF THE INVENTION

In conventional power plants, consumers such as steam or gas turbines, are driven by live steam from the boiler. The mass flow is routed through the live steam line. The control of the mass steam flow takes place by interposed turbine control valves. The conventional rated speed of a pertinent turbine for producing a 50 Hz frequency is 3000 rpm. The pertinent speed has to be kept within a narrow percentage range. So-called quick-action valves, acting as servo valves which under certain prerequisites or criteria can undergo transition into so-called "quick-action", are connected upstream of the actual turbine control valves. A specifiable criterion is, for example, coupling failure on the turbine shaft. This arrangement conventionally results in the turbine having a tendency to run in the direction of overspeed which can lead to its destruction. In this incipient case, in a very short available time interval, a safety circuit is triggered which blocks the mass flow upstream from the affected turbine, and thus, protects the turbine against overspeed and the concomitant damage.

In the known solutions, the so-called quick-action valves are generally hydraulically actuated, using an actuating device, generally in the form of a hydraulic cylinder (working cylinder). The hydraulic cylinder is equipped with plate springs. When the hydraulic cylinder is depressurized, under the action of the spring force, the piston rod of the cylinder extends in the process with the quick-action valve as the servo valve closing, and stops the mass flow supply to the turbine before it can reach the damaging overspeed range.

In the conventional safety circuits, as are used at present in turbine power plants, triggering of the working cylinder for actuating the respective quick-action valve of the turbine is implemented with solenoid valve concepts of simple structure. Malfunctions can relatively easily occur in the safety circuit, for example, when the actual switching function of the solenoid valve is disrupted by fouling or the like. Uncertainties in the safety circuit itself lead, of course, to uncertain conditions in the effective monitoring of the operating situation of the turbine. In the event of a process upset by failure of the safety circuit, major damage to the affected turbine can occur in the extreme case.

SUMMARY OF THE INVENTION

Objects of the present invention are to provide improved safety circuits and their operating processes such that operating reliability for the respective consumer is established to a high degree, and such that the area of application of the safety circuit is not be limited to the field of turbines or power plants.

These objects are basically achieved by a safety circuit and an operating process where at least one further solenoid valve is connected at least to one of the other solenoid valves such that only with simultaneous triggering of at least two solenoid valves does at least one control valve, connected to the fluid circuit, act on the actuating device (lifting cylinder with plate spring assembly). Each individual essential component of the safety circuit, especially in the form of valves, can be permanently checked regardless of whether the power plant is in operation or has been shut down. Even in operation of the plant, it is possible to always check some of the valves. With other components, especially in the form of other solenoid valves, it is possible to ensure the safety function, so that high availability for the entire plant results therefrom. The solenoid valves used can be optimized to the respective safety application so that here very short switch-back times can ensue, even when using the spring resetting, as is conventional in these valve for the valve piston.

With the safety circuit of the present invention, operation is possible in which, in specifiable time cycles, the individual solenoid valves can be checked for their operating reliability, for example from a control room. Always, at least two solenoid valves can be excluded from the pertinent testing to ensure the redundant safety function for the respective consumer. The safety circuit can trigger a specifiable oil-volumetric flow in a short time (60-80 ms), almost unpressurized to the tank side of the fluid circuit, to thus relieve the actuating device of its trigger pressure. For example, under the action of an energy storage device, such as a plate spring, the actuating device, preferably in the form of a spring-loaded lifting cylinder, can induce triggering of the quick-action valve to cut off the consumer, preferably in the form of a steam or gas turbine, from its flow of medium (steam). To implement this safety concept, the respective solenoid valves of the safety circuit are preferably connected to one another to carry fluid in the form of a series connection, such that one output of one valve is always connected to carry fluid to the input of another valve. At least one input control line of the respective control valve is connected to the input side of at least one assignable solenoid valve.

Furthermore, at least some of the control valves are preferably connected in parallel to one another such that when they are simultaneously opened by the triggered solenoid valves. A large volumetric flow can be then managed. Preferably so-called cartridge valves are used as control valves. As a result of their structure, they ensure high operating reliability. These cartridge valves are also called logic valves in technical jargon. Their structure and their operation are described for example in Volume 4 of the *Hydraulic Trainer* of Mannesmann Rexroth (1989 edition, Print number RD 00280/01.89-1st edition). The subject matter of which is hereby incorporated by reference.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF THE INVENTION

Figure 1:
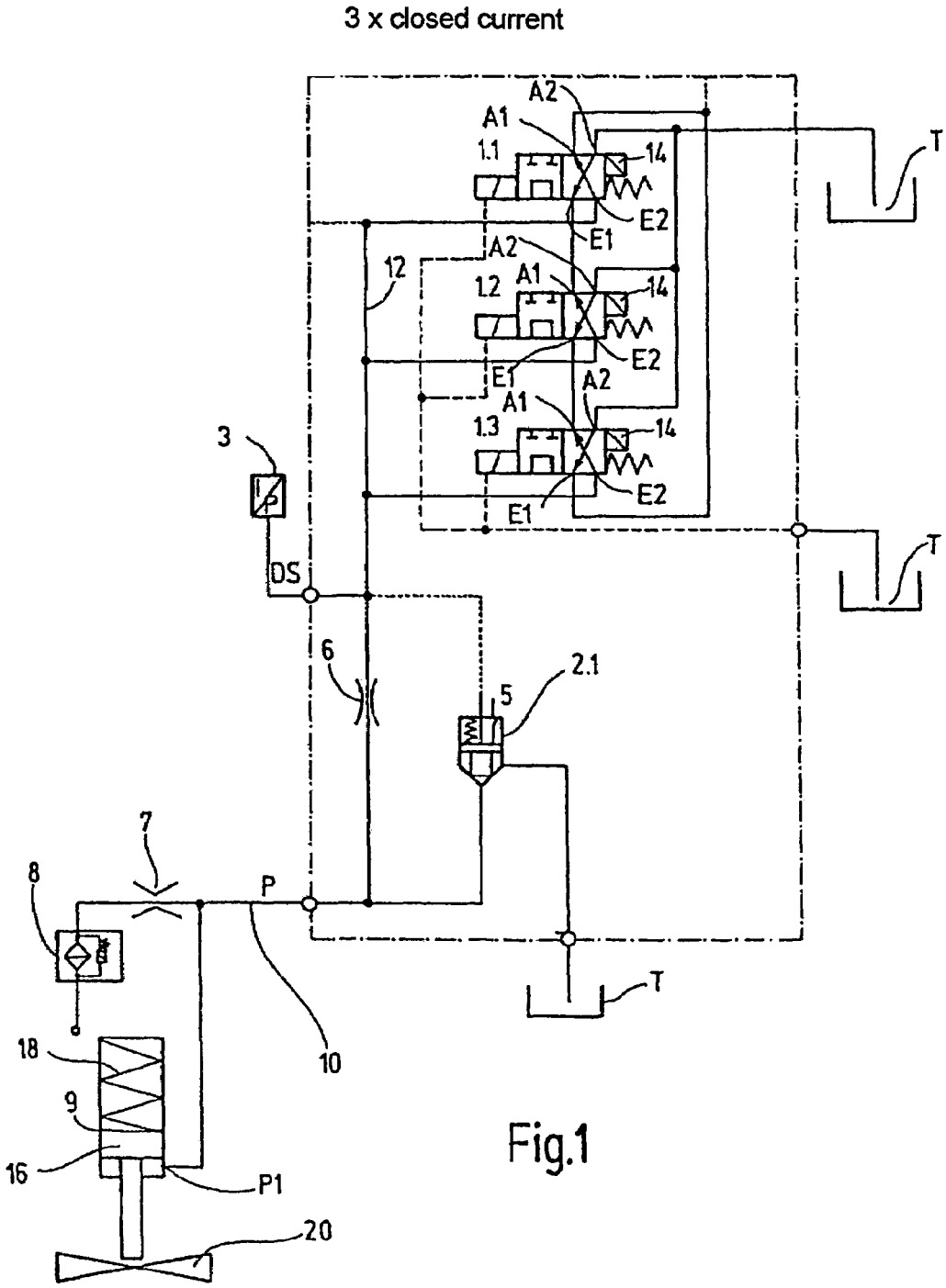
FIG. 1 is a schematic circuit diagram of a safety circuit according to a first embodiment of the present invention, with three solenoid valves and one cartridge valve.

The basic structure of the safety circuit will be described first using the first embodiment of FIG. 1. The safety circuit of the present invention has three solenoid valves 1.1, 1.2, and 1.3. The safety circuit as shown in FIG. 1 has a single cartridge valve 2.1. At a tapping point, DS the system pressure can be detected by an electrical pressure transducer 3. The cartridge valve 2.1 is spring-loaded and has a proximity or limit switch 5 to detect the operating position of the cartridge valve 2.1. The safety circuit is provided with a choke 6 and a choke or orifice 7. This orifice 7 leads to a filter unit 8 which in turn is connected on the input side to part of the fluid circuit 10 and through which operating fluid under pressure is conveyed. An actuating device 9 between the connecting point P and the choke 7 discharges into the fluid circuit 10.

All three solenoid valves 1.1, 1.2, 1.3 are shown in their closed-current position, that is, in their de-energized position. In that position the respective inputs and outputs of the solenoid valves as shown are connected crosswise to one another carrying fluid. One output A1 each of a solenoid valve 1.1, 1.2, 1.3 is applied to the respective input E1 of the solenoid valve which follows in series. The respective other input E2 is connected to a feed line 12 of the fluid circuit 10 to carry fluid. The other outputs A2 of the respective solenoid valve 1.1, 1.2, 1.3 are connected on the one hand to one another to carry fluid and otherwise are connected to the tank T of the fluid circuit 10 to carry fluid. One input side of the cartridge valve 2.1 discharges in the direction of the connecting point P into the fluid circuit 10. On the output side, as shown in FIG. 1, the cartridge valve 2.1 is connected to the tank T.

In its further energized operating position, the respective solenoid valve 1.1, 1.2, 1.3 according to the circuit diagram would connect the inputs E1 and E2 to one another and block the outputs A1, A2. The solenoid valves 1.1, 1.2, 1.3 are held spring-loaded in their closed-current position. The respective position of the solenoid valve can be checked by way of sensors 14.

The actuating device 9 includes a hydraulic working cylinder. The piston rod unit 16 of the cylinder is permanently spring-loaded, preferably by application of a compressive force by way of a plate spring 18. As shown in FIG. 1, the piston rod unit 16 as shown in FIG. 1, is held in the raised position against the compressive force of the plate spring 18 by the system pressure of the fluid circuit 10. When the pressure drops at the pressure input point P1 for the actuating device 9, the piston rod unit 16 is extended down and actuates the servo valve 20 which triggers the flow of medium to the respective consumer (not shown), for example halts the steam mass flow for driving a steam or gas turbine (not shown).

The actual purpose of the safety circuit is to send a certain volumetric flow of oil in a specified time (60 to 80 ms) to the greatest extent possible unpressurized to the tank T. The pressure difference $\Delta p$ available for this purpose also results from the characteristic of the spring assembly integrated in the actuating device 9 in the form of plate springs 18. The plate springs 18 act in the closure direction, i.e., the piston rod unit 16 is extended, and the design system pressure for the illustrated safety circuit should be at least 7 to 8 bar for a fully tensioned plate spring 18. Depending on the component choice for the safety circuit, system pressures up to 300 bar and more can be achieved.

The individual components are designed and matched to one another such that the resulting final-$\Delta$ p with the spring 18 relieved does not exceed 1.5 to 2 bars. When the solenoid valves 1.1, 1.2, and 1.3 have been triggered, i.e., are de-energized, this pressure is the criterion for unpressurized circulation, i.e., the oil volume determined by the orifice 7 is routed by way of the cartridge valve 2.1 to the tank T. Spring 18 in the hydraulic cylinder of the actuating device 9 is not tensioned. This operation takes place only when at least two of the solenoid valves with positions 1.1, 1.2, or 1.3 are connected to carry current.

As shown in FIG. 1, the indicated solenoid valves 1.1, 1.2, and 1.3 are shown de-energized and are monitored for their piston operating position. To ensure permanent verifiability of the components, the solenoid valves 1.1, 1.2, and 1.3 are provided with sensors 14, especially in the form of inductive proximity switches. These proximity switches can be used selectively as break contacts or make contacts.

In the starting situation all solenoid valves 1.1, 1.2, and 1.3 are initially connected to carry current, i.e., all control channels are blocked with respect to the outputs A2 to the tank T.

During normal operation of the safety circuit, one solenoid valve 1.1 or 1.2 or 1.3 is then always being checked alternatively. The pressure-carrying control holes both of the cartridge valve 2.1 and also those of the solenoid valves 1.1, 1.2, and 1.3 are not relieved from pressure on the input side. This means that the closing surface of the cartridge valve 2.1 is kept under system pressure and thus remains closed. When two or three solenoid valves of positions 1.1, 1.2, and 1.3 are triggered—de-energized—the pressure on the system is completely released. In the process, it is irrelevant which solenoid valves are switched off-circuit, if only two of them are switched off-circuit. The off-circuit switching of two solenoid valves results in the cartridge valve 2.1 being relieved on the closing surface and opening in an extremely short time. The common oil flow which results both from the closing process of the hydraulic cylinder 9 and also from the fluid flow which comes from the orifice 7 is then routed against the indicated differential pressure of approximately <1.5 to 2 bar from the input-side connection of the cartridge valve 2.1 in the direction of the output-side connection against atmospheric pressure into the tank T.

The limit switch 5, which can also be designed as a pressure transducer (not shown), then signals the current valve position (opened) of the cartridge valve 2.1 to a central location (control room or the like). This signaling allows the conclusion that a fault situation on the consumer (turbine) has been successfully eliminated by way of the servo valve 20 by closing it. The pressure transducer 3 monitors the pressure in the system in addition to monitoring the positions of the valve initiators in the form of sensors 14. The indicated safety circuit is basically designed as a closed-current circuit. Applications are also conceivable, especially in other technical fields, in which triggering of the safety function takes place by current flowing through the solenoid valves 1.1, 1.2, and 1.3. The monitoring of the system pressure, as indicated, moreover allows permanently electronic monitoring as an additional safety criterion. By using cartridge valves within the safety circuit, increased operating reliability is achieved.

The possible operating modes of the safety circuit are detailed below using a second embodiment as shown in FIGS. 2 to 8. If in the second embodiment components of the first embodiment are used, in this regard the same reference numbers are used, and previous statements also apply to the new, second embodiment. For the sake of simpler illustration in FIGS. 2 to 8, the working cylinder 9 is shown with only one connecting point.

The major difference from the above described first embodiment is that in the second embodiment, instead of only one cartridge valve 2.1, another corresponding second cartridge valve 2.2 is used. Furthermore, the two cartridge valves 2.1 and 2.2 are connected to one another to carry fluid on their output side and are connected to the tank T. On the input side, the two cartridge valves 2.1 and 2.2 are each connected to carry fluid to the output of two other cartridge valves 3.1 and 3. So active cartridge valves 3.1 and 3.2 have two control inputs X and Y. The two input sides of each cartridge valve 3.1 and 3.2 are connected to the feed line 12 of the fluid circuit 10. Another choke or orifice 4 is connected to the connecting line 22 between the two input lines of the cartridge valves 2.1 and 2.2.

The control connection X of the cartridge valve 3.1 together with the control connection Y of the cartridge valve 3.2 discharges into the connecting line between the output A1 and input E1 of the solenoid valve 1.3 and 1.2. The control connection X of the cartridge valve 3.2 together with the control connection Y of the cartridge valve 3.1 discharges into the connecting line between the output A1 and the input E1 of the solenoid valve 1.2 and solenoid valve 1.1.

Figure 2:
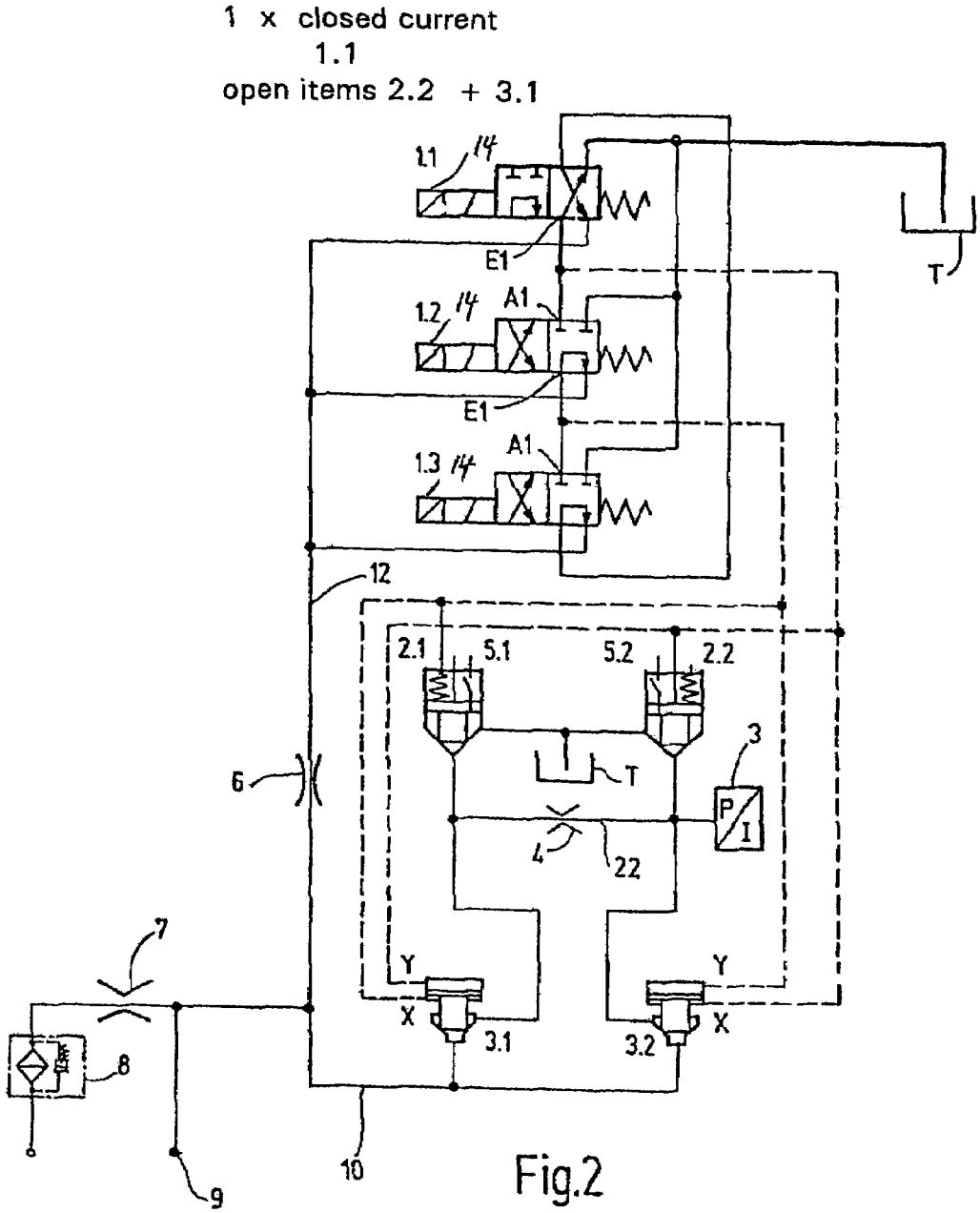
FIGS. 2 to 8 are schematic circuit diagrams of a safety circuit according to a second embodiment of the present invention in the invention in different switching and operating states, with three solenoid valves and at total of four cartridge valves.
Figure 3:
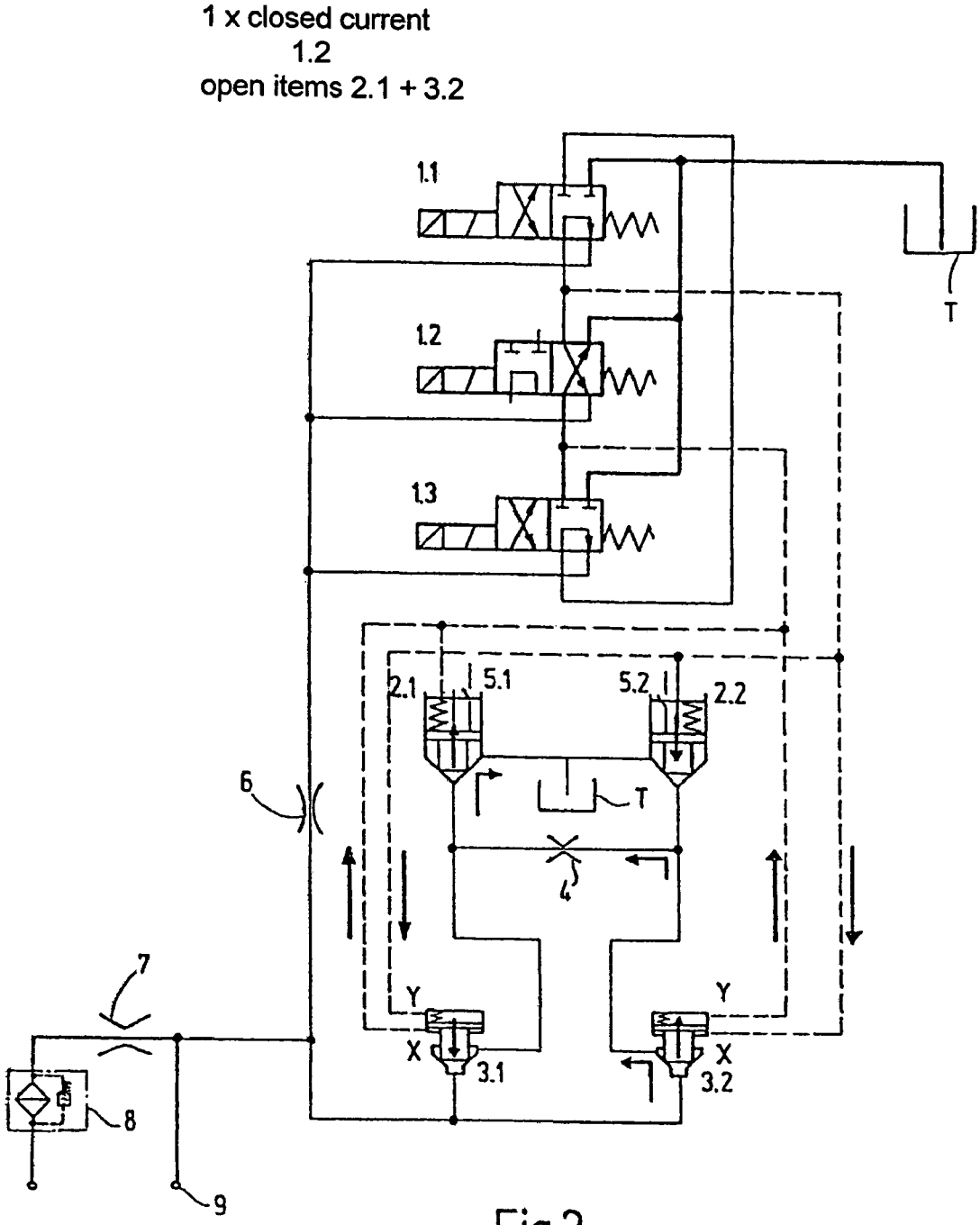
Figure 4:
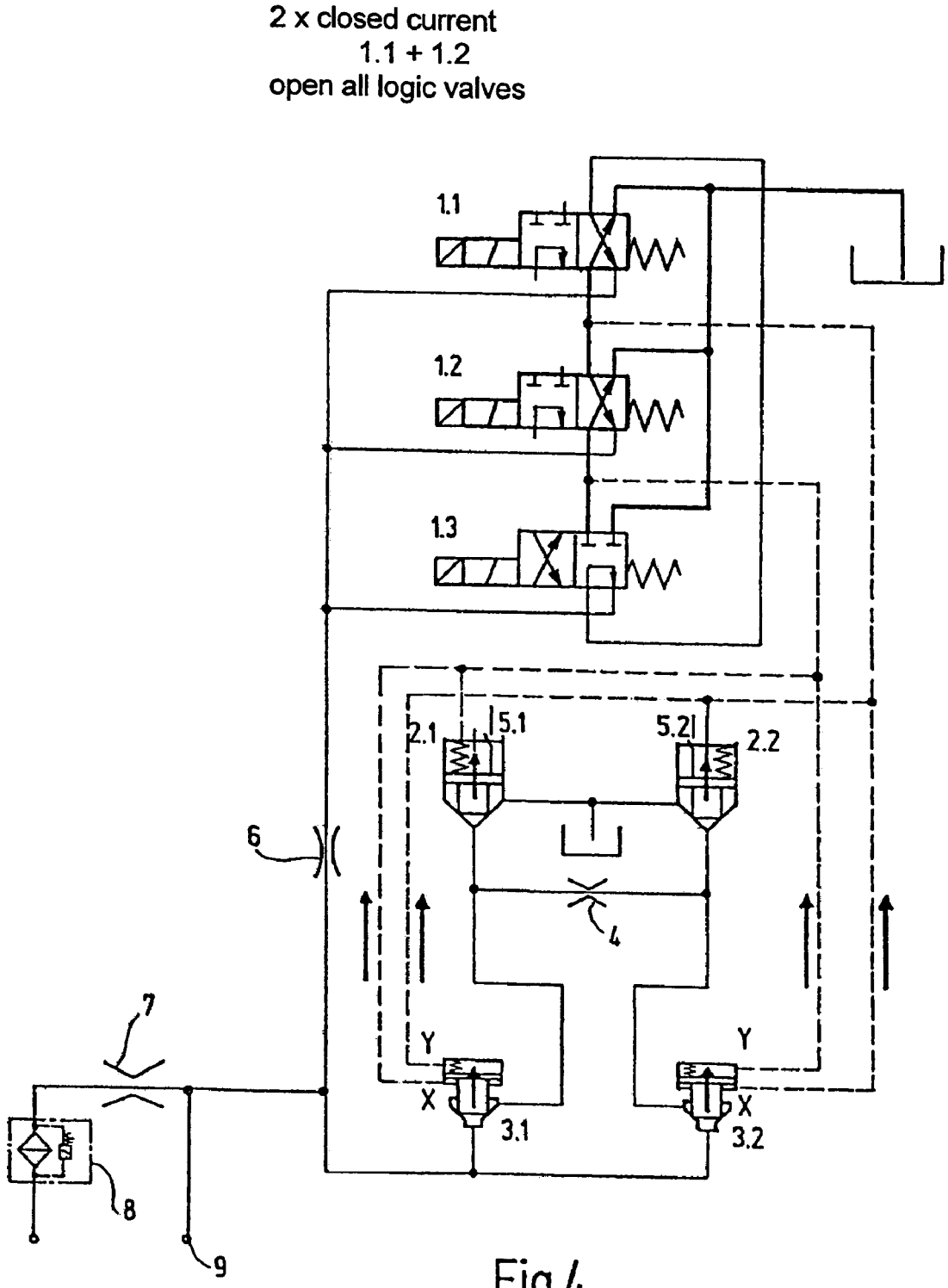
Figure 5:
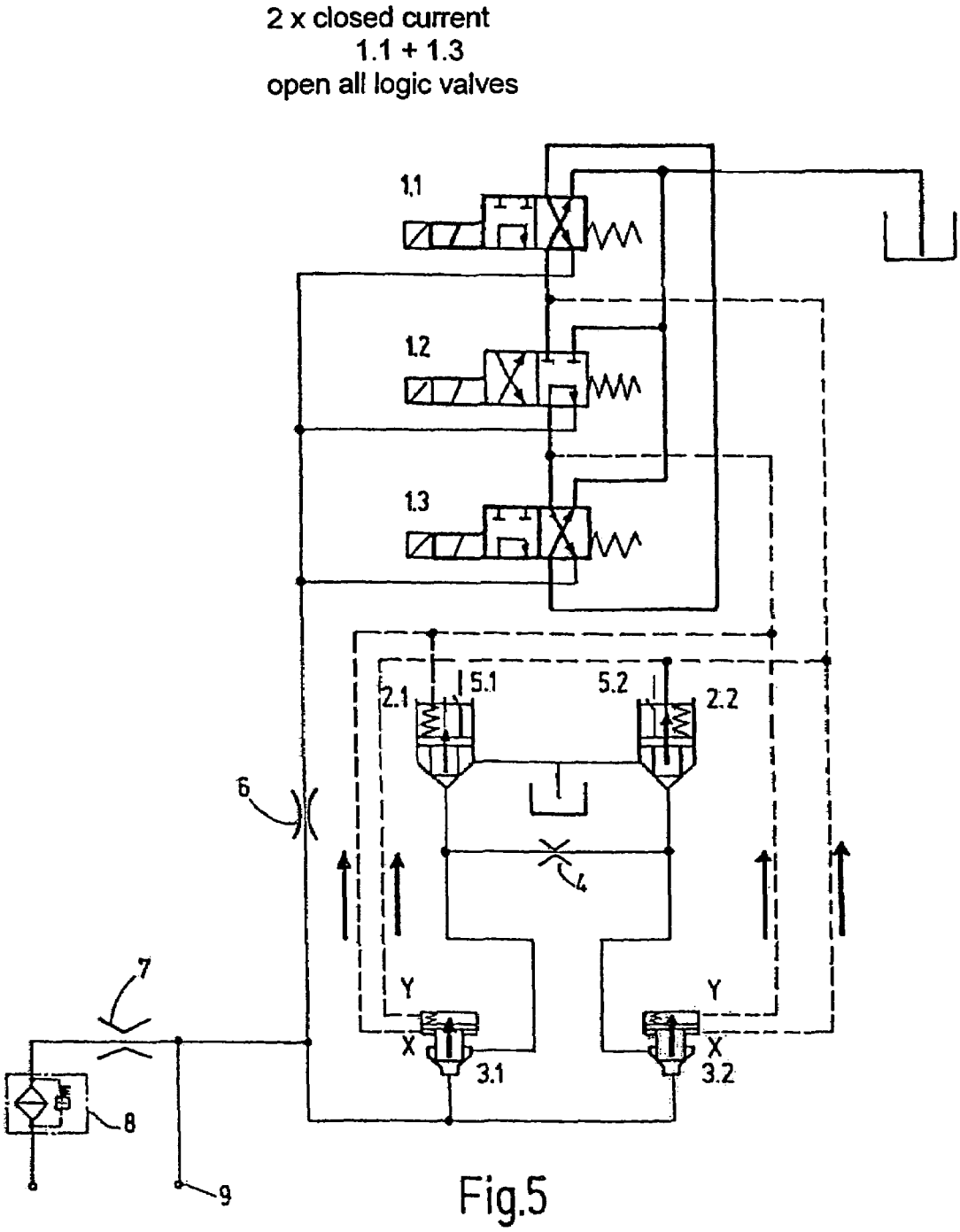
Figure 6:
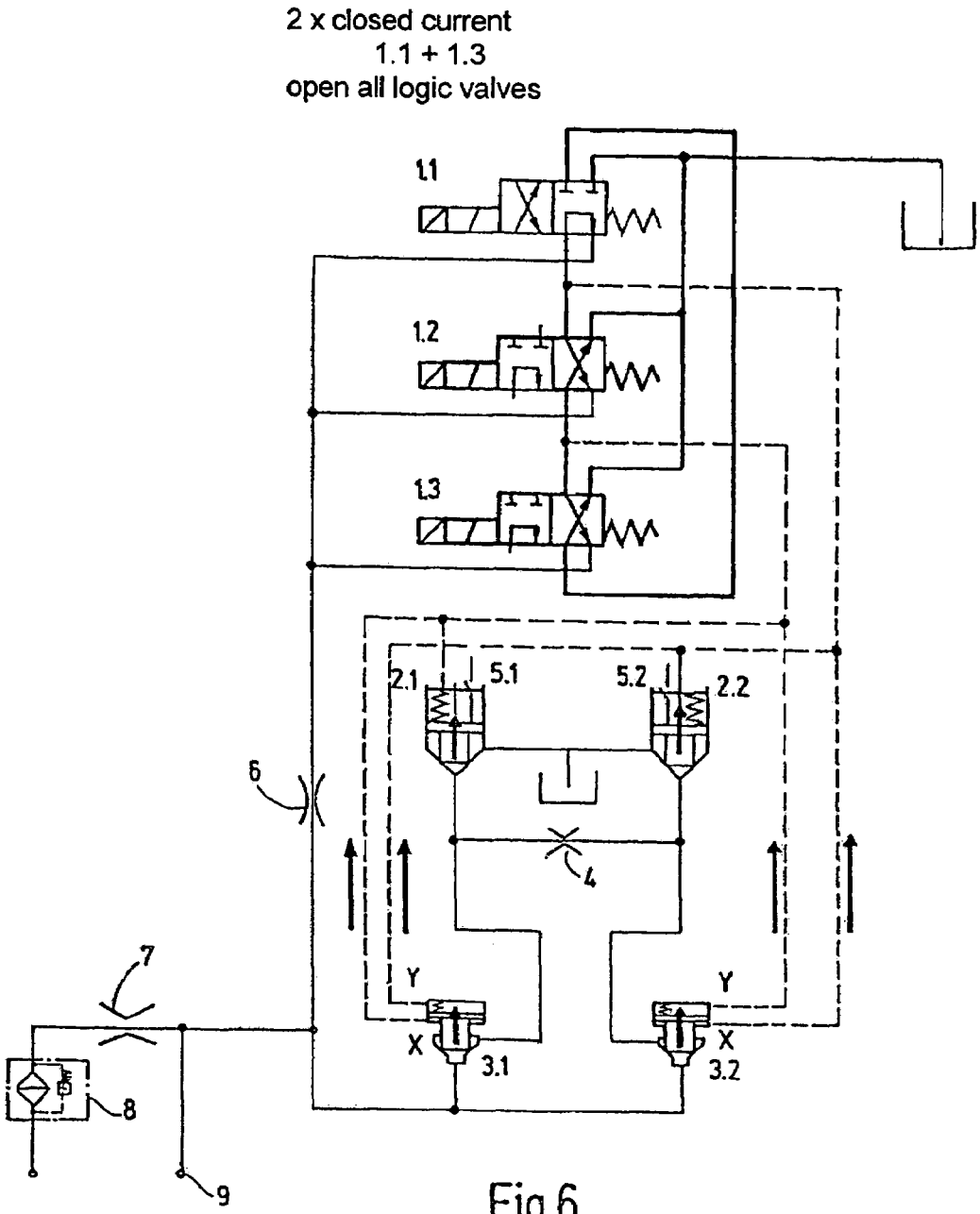
Figure 7:
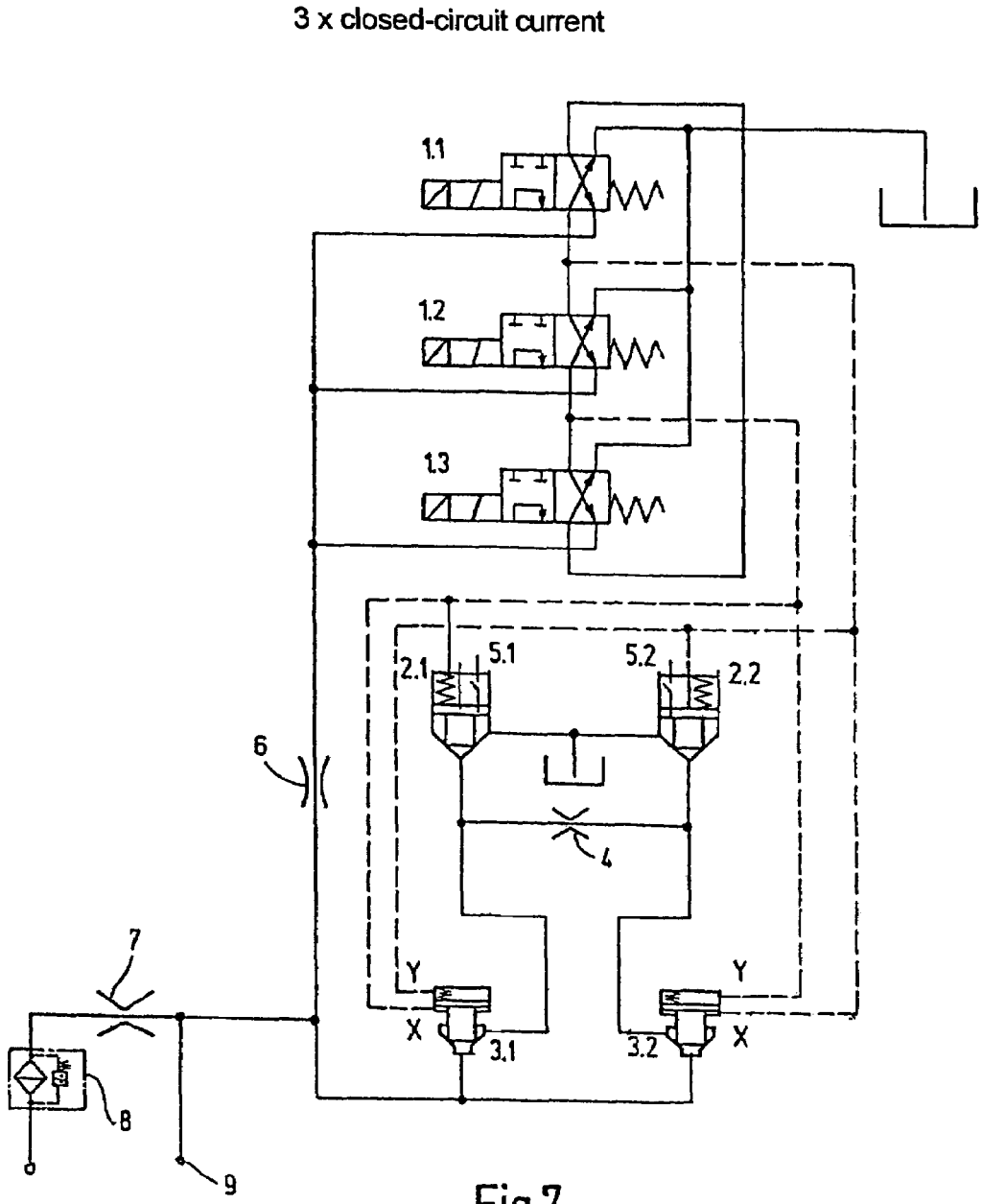
Figure 8:
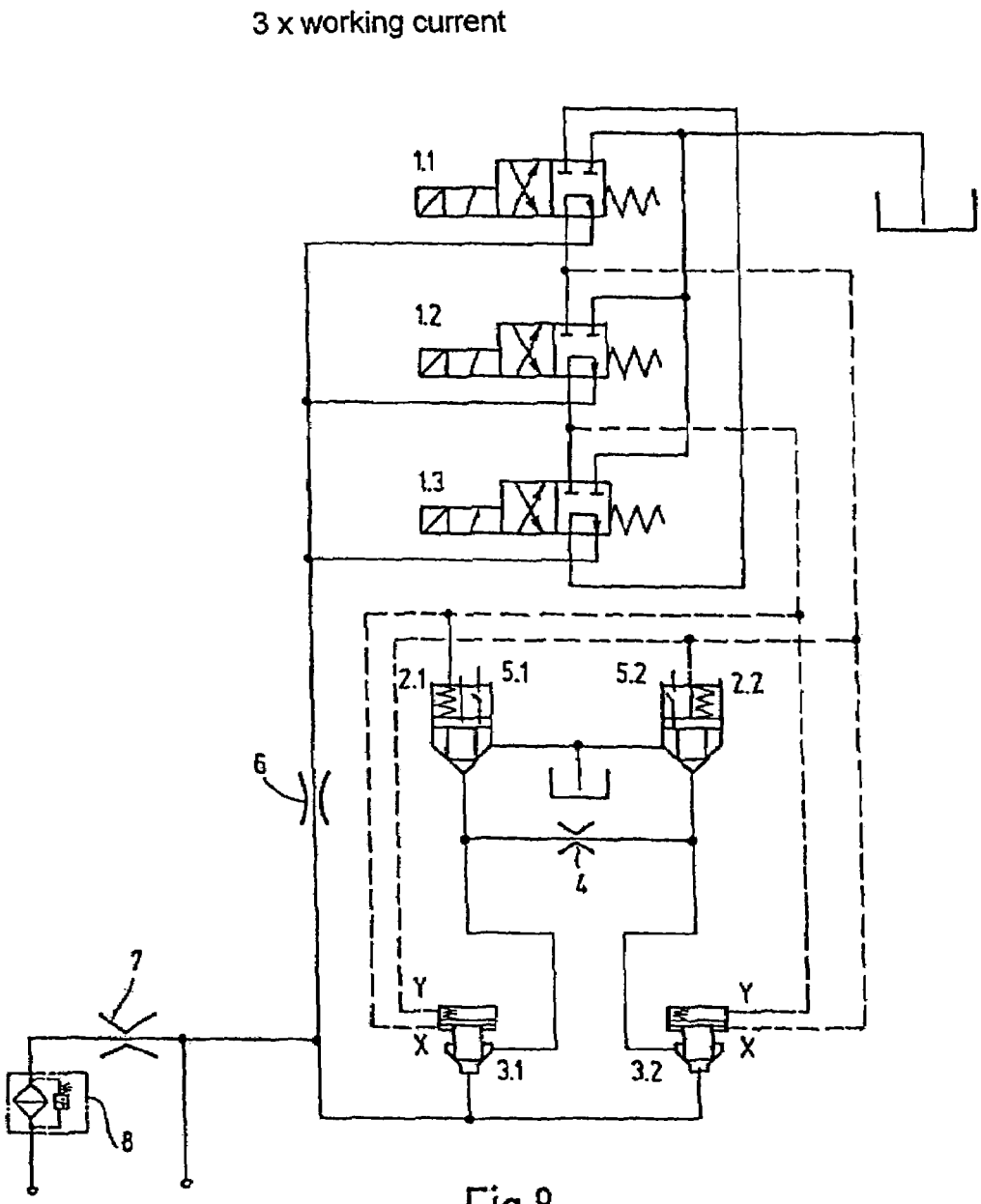

Based on the parallel wiring of all the logic valves 2.1, 2.2, 3.1, and 3.2 with the possibility of their simultaneous opening, a large volumetric flow can be routed unpressurized to the tank T in the shortest possible time. This arrangement is an advantage over a solution as shown in FIG. 1 with only one inserted cartridge valve 2.1. The position of the cartridge valves 2.1 and 2.2 is implemented or indicated in turn by limit switches 5.1 and 5.2. A control connection of the cartridge valve 2.1 is connected to the control connection X of the cartridge valve 3.1 and to the control connection Y of the cartridge valve 3.2. Furthermore, a control connection of the cartridge valve 2.2 is connected to the respective control line X and Y of the cartridge valves 3.2 and 3.1. The functionality of all inserted valves is monitored and reported by contact with the respectively assigned electrical sensors and others 14. In the permanent tests of the individual function groups and modules, the following relationships arise in the valve assignments and functions:

1. Testing 1× closed current relating to position 1.1 leads to opening of valve positions 2.2 and position 3.1 as shown in FIG. 2.
2. Testing 1× closed current relating to position 1.2 yields opening of the valve positions 2.1 and position 3.2 as shown in FIG. 3.
3. Testing 1× closed current relating to position 1.3 yields closing of all logic valves 2.1, 2.2, 3.1, 3.2 (not shown).
4. Testing 2× closed current relating to position 1.1 and position 1.2 yields opening of all logic valves as shown in FIG. 4.
5. Testing 2× closed current relating to position 1.1 and position 1.3 yields opening of all logic valves 2.1, 2.2, 3.1, 3.2 as shown in FIG. 5.
6. Testing 2× closed current relating to position 1.2 and position 1.3 yields opening of all logic valves 2.1, 2.2, 3.1, 3.2 as shown in FIG. 6.
7. Testing 3× closed current relating to position 1.1, position 1.2, and position 1.3 yields opening of all logic valves as shown in FIG. 7
8. Testing 3× working current relating to position 1.1, position 1.2, and position 1.3 yields closing of all logic valves as shown in FIG. 8.

With the safety of the present invention, in the form of a 2/3 safety control, there is the permanent possibility of verifiability of each actuatable individual component. At the same time, the untested system parts are able to perform the safety function. In a preferred embodiment, the pressure transducer 3, as shown in FIG. 2, is connected against the pertinent representation on both sides of the orifice 4 underneath the cartridge valves 2.1 and 2.2 to the fluid circuit 10.

While various embodiments have been chosen to illustrate the invention, it will be understood by those skilled in the art that various changes and modifications can be made therein without departing from the scope of the invention as defined in the appended claims.

What is claimed is:

1. A safety circuit for a media-operated consumer, comprising:

a fluid circuit including an actuating device acting simultaneously on consumer operating behavior;

a first solenoid valve connected to and acting on said fluid circuit;

a first control valve connected to said fluid circuit;

a second solenoid valve connected to at least said first solenoid valve such that simultaneous triggering of said first and second solenoid valves is required for said first control valve to act on said actuating device; and at least one second control valve connected in parallel to said first control valve such that said first and second control valves are simultaneously opened by triggering of said solenoid valves to manage a large volumetric flow.

2. A safety circuit according to claim 1 wherein said consumer is one of a steam turbine and a gas turbine.

3. A safety circuit according to claim 1 wherein said fluid circuit is a hydraulic circuit.

4. A safety circuit according to claim 1 wherein said solenoid valves are connected to one another to convey fluid in a series connection with an output of said first solenoid valve connected to an input of said second solenoid valve; and an input control line of said first control valve is connected to an input side of at least one of said solenoid valves.

5. A safety circuit according to claim 1 wherein each of said valves has a fluid connection point leading to a tank of the fluid circuit.

6. A safety circuit according to claim 1 wherein at least one choke is connected in fluid communication through a feed line coupled to at least one of said actuating device and said fluid circuit.

7. A safety circuit according to claim 1 wherein electrical sensors are coupled to said solenoid valves for checking operational reliability.

8. A safety circuit according to claim 7 wherein each said solenoid valve has a same structure in which a voltage drop operates on the respective electrical sensor to trigger a safety function.

9. A safety circuit according to claim 1 wherein each said solenoid valve is a 4/2-way valve; and said control valve is a cartridge valve with an active design.

10. A safety circuit according to claim 1 wherein said actuating device comprises a spring loaded working cylinder coupled to and actuating a servo valve controlling medium flow to the consumer.

11. A safety circuit according to claim 1 wherein
a third solenoid valve is connected to said second solenoid valve in series.

12. A process for operating a safety circuit for a media-operated consumer, the safety circuit including a fluid circuit with an actuating device acting simultaneously on consumer operating behavior, a first solenoid valve connected to and acting on the fluid circuit, a first control valve connected to the fluid circuit, a second solenoid valve connected to at least the first solenoid valve such that simultaneous triggering of the first and second solenoid valves is required for the first control valve to act on the actuating device, and a third solenoid valve connected in series to said second solenoid valve, the process comprising the steps of:
testing the solenoid valves individually for operating reliability thereof in specifiable cycles; and
excluding at least two solenoid valves from testing to ensure safety of the consumer.

13. A safety circuit for a media-operated consumer, comprising:
a fluid circuit including an actuating device acting simultaneously on consumer operating behavior;
a first solenoid valve connected to and acting on said fluid circuit;
a first control valve connected to said fluid circuit; and
a second solenoid valve connected to at least said first solenoid valve such that simultaneous triggering of said first and second solenoid valves is required for said first control valve to act on said actuating device, each of said valves having a fluid connection point leading to a tank of the fluid circuit.

14. A safety circuit according to claim 13 wherein
said consumer is one of a steam turbine and a gas turbine.

15. A safety circuit according to claim 13 wherein
said fluid circuit is a hydraulic circuit.

16. A safety circuit according to claim 13 wherein
said solenoid valves are connected to one another to convey fluid in a series connection with an output of said first solenoid valve connected to an input of said second solenoid valve; and
an input control line of said first control valve is connected to an input side of at least one of said solenoid valves.

17. A safety circuit according to claim 13 wherein
at least one choke is connected in fluid communication through a feed line coupled to at least one of said actuating device and said fluid circuit.

18. A safety circuit according to claim 13 wherein
electrical sensors are coupled to said solenoid valves for checking operational reliability.

19. A safety circuit according to claim 18 wherein
each said solenoid valve has a same structure in which a voltage drop operates on the respective electrical sensor to trigger a safety function.

20. A safety circuit according to claim 13 wherein
each said solenoid valve is a 4/2-way valve; and
said control valve is a cartridge valve with an active design.

21. A safety circuit according to claim 13 wherein
said actuating device comprises a spring loaded working cylinder coupled to and actuating a servo valve controlling medium flow to the consumer.

22. A safety circuit according to claim 13 wherein
a third solenoid valve is connected to said second solenoid valve in series.

23. A safety circuit for a media-operated consumer, comprising:
a fluid circuit including an actuating device acting simultaneously on consumer operating behavior;
a first solenoid valve connected to and acting on said fluid circuit;
a first control valve connected to said fluid circuit, said control valve being a cartridge valve with an active design; and
a second solenoid valve connected to at least said first solenoid valve such that simultaneous triggering of said first and second solenoid valves is required for said first control valve to act on said actuating device, each said solenoid valve is a 4/2-way valve.

24. A safety circuit according to claim 23 wherein
said consumer is one of a steam turbine and a gas turbine.

25. A safety circuit according to claim 23 wherein
said fluid circuit is a hydraulic circuit.

26. A safety circuit according to claim 23 wherein
said solenoid valves are connected to one another to convey fluid in a series connection with an output of said first solenoid valve connected to an input of said second solenoid valve; and
an input control line of said first control valve is connected to an input side of at least one of said solenoid valves.

27. A safety circuit according to claim 23 wherein
at least one choke is connected in fluid communication through a feed line coupled to at least one of said actuating device and said fluid circuit.

28. A safety circuit according to claim 23 wherein
electrical sensors are coupled to said solenoid valves for checking operational reliability.

29. A safety circuit according to claim 28 wherein
each said solenoid valve has a same structure in which a voltage drop operates on the respective electrical sensor to trigger a safety function.

30. A safety circuit according to claim 23 wherein
said actuating device comprises a spring loaded working cylinder coupled to and actuating a servo valve controlling medium flow to the consumer.

31. A safety circuit according to claim 23 wherein
a third solenoid valve is connected to said second solenoid valve in series.

32. A safety circuit for a media-operated consumer, comprising:
a fluid circuit including an actuating device acting simultaneously on consumer operating behavior;
a first solenoid valve connected to and acting on said fluid circuit;
a first control valve connected to said fluid circuit;
a second solenoid valve connected to at least said first solenoid valve such that simultaneous triggering of said first and second solenoid valves is required for said first control valve to act on said actuating device; and
a third solenoid valve connected to said second solenoid valve in series.

33. A safety circuit according to claim 32 wherein
said consumer is one of a steam turbine and a gas turbine.

34. A safety circuit according to claim 32 wherein
said fluid circuit is a hydraulic circuit.

35. A safety circuit according to claim 32 wherein
said solenoid valves are connected to one another to convey fluid in a series connection with an output of said first solenoid valve connected to an input of said second solenoid valve; and an input control line of said first control valve is connected to an input side of at least one of said solenoid valves.

36. A safety circuit according to claim 32 wherein at least one choke is connected in fluid communication through a feed line coupled to at least one of said actuating device and said fluid circuit.

37. A safety circuit according to claim 32 wherein electrical sensors are coupled to said solenoid valves for checking operational reliability.

38. A safety circuit according to claim 37 wherein each said solenoid valve has a same structure in which a voltage drop operates on the respective electrical sensor to trigger a safety function.

39. A safety circuit according to claim 32 wherein said actuating device comprises a spring loaded working cylinder coupled to and actuating a servo valve controlling medium flow to the consumer.

* * * * *